US012006697B2

(12) United States Patent
Sarrablo Moreno

(10) Patent No.: US 12,006,697 B2
(45) Date of Patent: Jun. 11, 2024

(54) ARCHITECTURAL ENCLOSURE COMPRISING A STRUCTURAL ELEMENT AND AN IMPROVED FLEXIBLE BRICK SHEET

(71) Applicant: FLEXBRICK, S.L., Els Hostalets de Pierola (ES)

(72) Inventor: Vicente Sarrablo Moreno, Castelldefels (ES)

( * ) Notice: Subject to any disclaimer, the term of this patent is extended or adjusted under 35 U.S.C. 154(b) by 401 days.

(21) Appl. No.: 17/413,633

(22) PCT Filed: Dec. 12, 2018

(86) PCT No.: PCT/ES2018/070799
§ 371 (c)(1),
(2) Date: Jun. 14, 2021

(87) PCT Pub. No.: WO2020/120810
PCT Pub. Date: Jun. 18, 2020

(65) Prior Publication Data

US 2022/0034096 A1 Feb. 3, 2022

(51) Int. Cl.
*E04F 13/00* (2006.01)
*E04B 1/24* (2006.01)
(Continued)

(52) U.S. Cl.
CPC ..... *E04F 13/0826* (2013.01); *E04B 1/24* (2013.01); *E04B 1/32* (2013.01); *E04F 10/08* (2013.01);
(Continued)

(58) Field of Classification Search
CPC ..... E04F 13/073; E04F 13/074; E04F 13/075; E04F 13/08; E04F 13/0826; E04F 13/0862; E04F 13/142; E04F 13/147; E04F 15/166; E04F 15/20; E04B 1/24; E04B 1/2403; E04B 2001/2409; E04B 2001/2424; E04B 1/32
See application file for complete search history.

(56) References Cited

U.S. PATENT DOCUMENTS 1,994,644 A 3/1935 Harshberger et al.
3,768,225 A * 10/1973 Sloan ..... E04C 2/041 52/425
(Continued)

FOREIGN PATENT DOCUMENTS

DE 1020175 B 11/1957
GB 2139676 A1 11/1984
WO 0071823 A1 11/2000

*Primary Examiner* — Chi Q Nguyen
(74) *Attorney, Agent, or Firm* — Eugenio J. Torres-Oyola; Victor M. Rodriguez-Reyes; Rafael Rodriguez-Muriel

(57) ABSTRACT

An architectural enclosure comprising a plurality of inter-woven flexible rods (10) forming a lattice of first rods (11) parallel to each other attached to the structural element (60) and of second rods (12) parallel to each other orthogonal to the first rods (11), and a plurality of bricks (20) with grooves (21) on their sides containing at least parts of some of said rods (10) wherein some of the first rods (11) are facing portions of the structural element (60) their entire length, and are joined thereto at regular intervals by means of clamps (50), attached to said portions of the structural element (60), surrounding the corresponding first rod (11).

15 Claims, 4 Drawing Sheets

(51) Int. Cl.

| | |
|---|---|
| ***E04B 1/32*** | (2006.01) |
| ***E04F 10/08*** | (2006.01) |
| ***E04F 13/08*** | (2006.01) |
| ***E04F 13/14*** | (2006.01) |
| ***E04F 15/16*** | (2006.01) |

(52) U.S. Cl.
CPC ..... *E04F 13/0862* (2013.01); *E04F 13/142* (2013.01); *E04F 15/166* (2013.01); *E04B 2001/2424* (2013.01)

(56) References Cited

U.S. PATENT DOCUMENTS

| | | | | |
|---|---|---|---|---|
| 3,932,696 | A * | 1/1976 | Fork | H02G 3/283 169/48 |
| 4,152,875 | A | 5/1979 | Soland et al. | |
| 5,335,472 | A * | 8/1994 | Phillips | E04C 3/44 D25/138 |
| 6,568,141 | B2 * | 5/2003 | Kremers | E02D 27/02 249/34 |
| 7,278,244 | B1 * | 10/2007 | Rubio | E04C 3/07 52/351 |
| 8,161,699 | B2 * | 4/2012 | LeBlang | E04C 3/09 52/309.4 |
| 8,733,047 | B1 * | 5/2014 | Hanson | E04B 2/845 52/348 |
| 8,800,218 | B2 * | 8/2014 | Robak | E04B 2/8652 52/302.1 |
| 9,157,234 | B1 * | 10/2015 | Foster | E04B 2/8652 |
| 11,162,237 | B2 * | 11/2021 | Benton, Jr. | E02B 3/122 |
| 11,299,886 | B2 * | 4/2022 | El-Domiaty | E04B 2/7409 |
| 2007/0199266 | A1 * | 8/2007 | Geilen | E04C 2/205 52/426 |
| 2016/0281361 | A1 * | 9/2016 | Baader | E04C 2/34 |

* cited by examiner

ARCHITECTURAL ENCLOSURE COMPRISING A STRUCTURAL ELEMENT AND AN IMPROVED FLEXIBLE BRICK SHEET

FIELD OF THE ART

This invention concerns an architectural enclosure comprising a structural element and an improved flexible brick sheet comprising a lattice of metal rods and a plurality of bricks retained in substantially stable positions on said lattice. The sheet of the present invention is suitable, for instance, for the construction of architectural facing brick elements such as vented façades, trellis, pergolas, linings, etc.

STATE OF THE ART

The international patent application WO 00/71823, by the same inventor of the present invention, discloses a flexible brick sheet and a construction procedure of domed coverings of reinforced masonry with their intrados finished using said flexible brick sheet. The sheet comprises a flexible laminar support provided with a plurality of bores, normally a metal plate with cuts later stretched, known as expanded metal, on which a plurality of bricks arranged as a board forming a lattice are attached, with separation spaces aligned between the bricks. In opposite ends of said laminar support stiffening and fastening transverse elements are attached, for instance, by welding. Along said separation spaces between bricks a plurality of first masonry bars attached by their ends are arranged, for example, by welding, to each of said stiffening and fastening elements. These first masonry bars are also connected to a series of points of said laminar support by spacers likewise attached by welding.

ES2322740, also by the same inventor, discloses a flexible brick sheet which is described as being connected to a rod lattice by lateral grooves made on the perimetric sides of the brick.

However, the described solution in the above document ES2322740 has a few shortcomings, such as, for example, that the rods may slightly shift within the grooves, causing the misalignment of the bricks, or producing movements and noise of the bricks with the wind.

Other problems of the solution described in this background art is that the bricks are difficult to insert within the rod lattice.

That solution also offers improvement options in the security area, since an accidental shifting of a rod, for example due to a strong impact on the bricks or due to strong wind, might release some of the bricks, causing their fall.

The breakage of the brick could also cause its total or partial fall, in accordance with the solution described in that document.

All of these shortcomings of the solution described in said document have been subject of study and improvement, those improvements being put together in this application.

BRIEF DESCRIPTION OF THE INVENTION

This invention concerns an architectural enclosure comprising a structural element and an improved flexible brick sheet. It will be understood that an architectural enclosure is an architectural element which allows to delimit a space, whether vertically or horizontally, such as, for example, a trellis, a wall, a pergola, a façade, etc.

The proposed architectural enclosure consists of a structural element, comprising at least a first profile, and multiple second profiles perpendicular to the first profile, responsible for supporting a brick sheet. Said brick sheet comprises, in a known manner in the existing state of the art:

- a plurality of flexible interwoven rods forming a lattice of first rods parallel to each other attached to said at least one first profile and of second rods parallel to each other orthogonal to the first rods, and
- a plurality of bricks provided with two main opposite sides of larger size, and four perimetric sides, at least two of which are mutually opposite and include fastening configurations by way of grooves, each one accessible through an opening and provided with a bottom portion corresponding to the part of the groove furthest from the opening, said grooves running along the larger length of the perimetric side wherein they are housed and containing at least parts of some of said rods to retain said bricks in said lattice.

Thus, each brick will be a flattened rectangular prism, offering two main sides, of larger size, connected through four perimetric sides.

At least two of those mutually opposing perimetric sides will contain grooves which will cross them along their maximum length, the ends of each groove thereby remaining open and accessible through the other two perimetric sides.

Each groove consists of an opening, which is the elongated aperture made on the perimetric side wherein said groove is formed and which gives access to the interior of said groove, and a bottom portion corresponding to the part of the groove furthest from the opening.

At least parts of the interwoven rods will remain inserted within said grooves, in the bottom portion, the brick being retained in the lattice formed by the interwoven rods. The rods inserted within the grooves may be both the first rods and the second rods, according to the composition of the desired architectural enclosure.

However, the present invention proposes, in a way unknown in the prior state of the art, that some of the first rods be opposed to the second profiles their entire length, and that they be joined thereto at regular intervals by clamps attached to said second profiles, said clamps surrounding the corresponding first rod preventing the second rods from sliding through said clamp.

This feature offers an additional attachment to the end attachment of the first rods, which increases the safety of the assembly and reduces the movements and vibrations that the brick sheet may produce due to the wind. Also, if the end attachments of the first rods should accidentally fail, the clamps would act as a redundant safety feature and would retain the brick sheet in its place avoiding detachments, because the second rods cannot pass through the clamps, thereby keeping the brick sheet from sliding by the clamps due to the effect of gravity after a hypothetical failure of an upper attachment of one end of the first rods to the first profile.

According to an additional embodiment, each clamp may consist of a U-shaped piece provided with two opposite straight ends connected with each other through an arcuate intermediate portion, said clamp defining a housing that is traversed by the first rod.

The second profile will, preferably, be located between the opposed straight ends of the clamp, such that a screw or rivet that goes through both the second profile and the two opposed straight ends will cause the attachment of the clamp to the structural element.

It is also proposed that a washer may be threaded around the clamp, pressing the first rod against the intrados of the arcuate intermediate portion of the clamp. This will avoid the rods from being shifted and inserted between the second profile and the clamp by the effect of the wind. Said washer may be metallic or made of a rigid material.

Other proposed features to reduce vibrations and noise that the brick sheet may cause is that each groove of the bricks be wider in its opening than in its bottom portion, and that the bottom portion of each groove and the part of the rod contained therein have clearance to move, which could cause misalignments, vibrations and noise by action of the wind.

Therefore, it is proposed that the groove width be more reduced in its bottom portion than in its opening, facilitating the insertion of the part of the rod, and that that said part of the rod and the bottom portion be sized and configured to remain snuggly coupled, preventing thereby any movement or vibration of the brick relative to the rod, and ensuring a correct alignment.

Preferably, each groove will have a wedge-shaped section, that is a gradual reduction of its width in relation to the opening. This configuration allows for the guiding of the part of the rod from the opening to the bottom portion, where it will be fitted.

Preferably, the bottom portion furthest from the opening has a width equal to or less than the width of the part of the rod contained within the groove, thus ensuring that the part of the rod will be nested within the groove when it reaches the bottom of the groove, or previously getting retained between the groove walls.

It is also proposed that at least a brick ridge, corresponding to the joint ridge between the rear side and a perimetric side containing a groove, be a bevelled ridge. This bevelled ridge eases the mounting of the assembly, as it eases the insertion of the brick by pressure within the rod lattice. Said bevelled ridge will push the corresponding part of the rod allowing the insertion of the brick between two parallel rods without the need for tools.

According to another embodiment, two parallel rods, one located on either side of the brick and having parts inserted in two grooves of the brick located on opposite perimetric sides thereof, are connected with each other by at least a retaining device, said retaining device being connected with a portion of each adjacent rod to the part of the rod inserted within the groove. That is, a retaining device connects the non-inserted part of two rods that run along the corresponding grooves. This retaining device keeps the rods from being separated, which avoids their being accidentally removed from the grooves, causing the release of the brick.

Therefore, the retaining device is a safety element which keeps a brick from accidentally being released from the rod lattice.

Said retaining device may be, for example, a rigid rod with hook configurations on its ends, each hook configuration surrounding one of said rods. Said hook configurations, which will preferably be symmetrical, will prevent the two rods from moving away from one another. Keeping the separation distance between both hook configurations smaller than the brick width in the direction between the two parallel rods, will prevent the rods from being removed from the grooves without first removing said retaining device.

According to another proposed embodiment, said bricks include multiple through-holes which traverse them from a perimetric side to another opposite perimetric side, making the brick lighter.

A fall-preventing device may be, at least partially, snuggly inserted in said multiple through-holes, allowing to maintain the brick in its position within the rod lattice even if the brick should suffer accidental breakage, thereby preventing falls of brick fragments.

The parts of said fall-preventing device inserted in the through-holes of the brick may be, for example, harpooned shanks. The harpooned shanks are shanks provided with flexible or deformable tabs, such that, when inserting the shank in a through-hole, said tabs are deformed to allow said insertion, producing a press-fit joint between the shank and the walls of the gap between bricks. Preferably, the fall-preventing device will be manufactured of a plastic material, although it is also contemplated that they be manufactured of a metallic material.

It is also proposed that the rods may be undulating.

The architectural enclosure obtained may have different configurations, depending on how the first rods and the first profiles are arranged. The following three configurations are proposed:

- a vertical suspended architectural enclosure in which said at least one first profile is a single first crowning profile, the first rods are vertical and are joined to the first profile by one of its ends;
- an architectural catenary enclosure in which at least one first profile is two first end profiles, the first rods forming a catenary arch and are joined to second first profiles by their two ends;
- a horizontal architectural enclosure in which said at least one first profile is a plurality of first parallel profiles, the first rods are horizontal and joined to the first profiles at intermediate points.

It will be understood that the references to geometric positions, such as parallel, perpendicular, tangential, etc., for instance, allow for deviations up to ±3° relative to the theoretical position defined by said nomenclature.

Other features of the invention will appear in the following detailed description of an embodiment example.

BRIEF DESCRIPTION OF THE FIGURES

The foregoing and other advantages and features will more fully understood from the following detailed description of an embodiment example with reference to the attached drawings, which must be taken in an illustrative and non-limiting manner, wherein.

DETAILED DESCRIPTION OF AN EMBODIMENT EXAMPLE

The attached figures show embodiment examples of the present invention with an illustrative non-limiting nature.

Figure 1A:
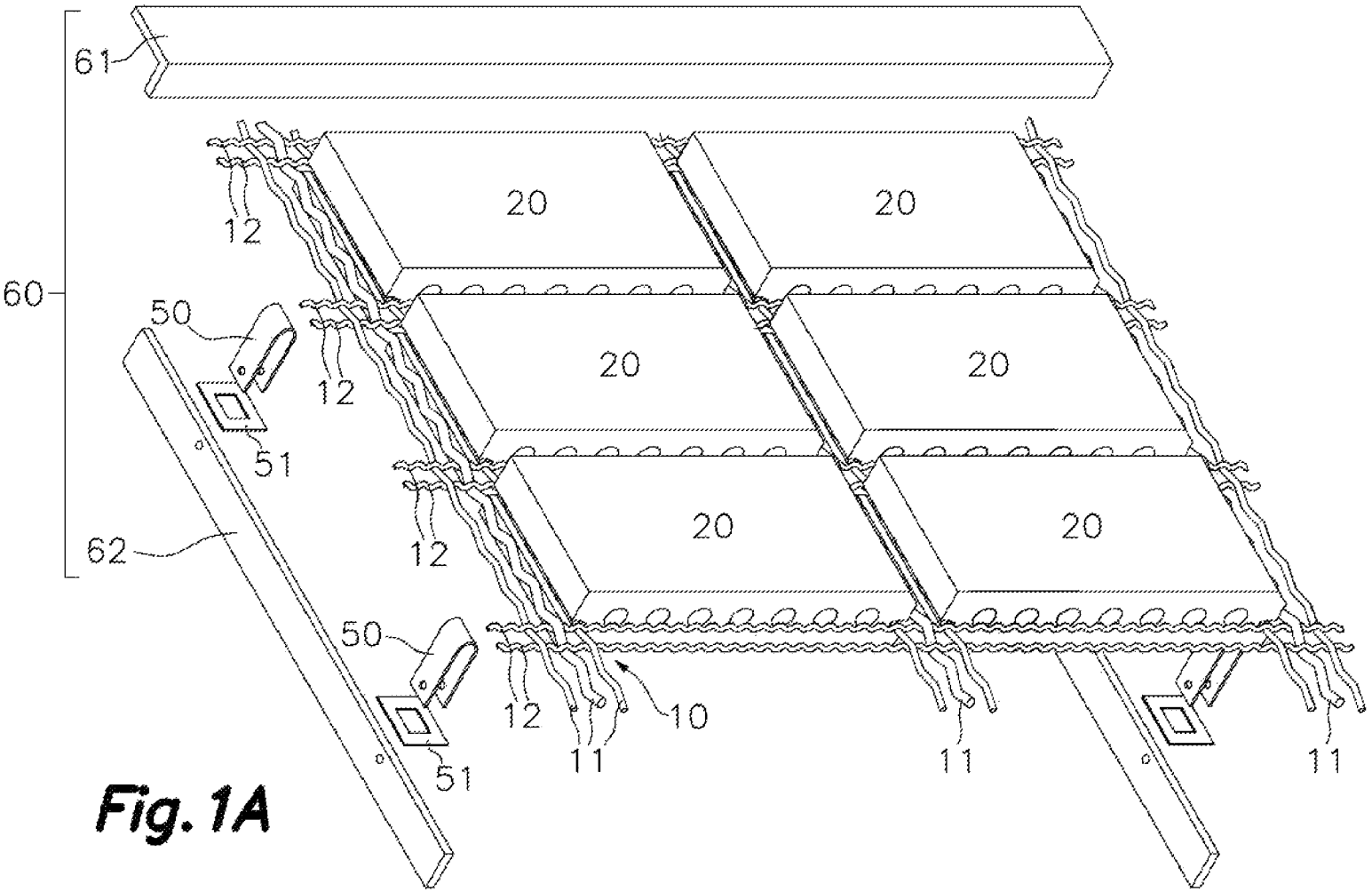
FIG. 1A shows a perspective view of a portion of a flexible brick sheet formed by undulating interwoven rods forming a mesh with bricks inserted in said mesh, showing a structural element and some clamps, in an exploded view, according to a first embodiment wherein the first rods are vertical and are joined to a first profile by one of their ends, generating a vertical suspended architectural enclosure.
Figure 1B:
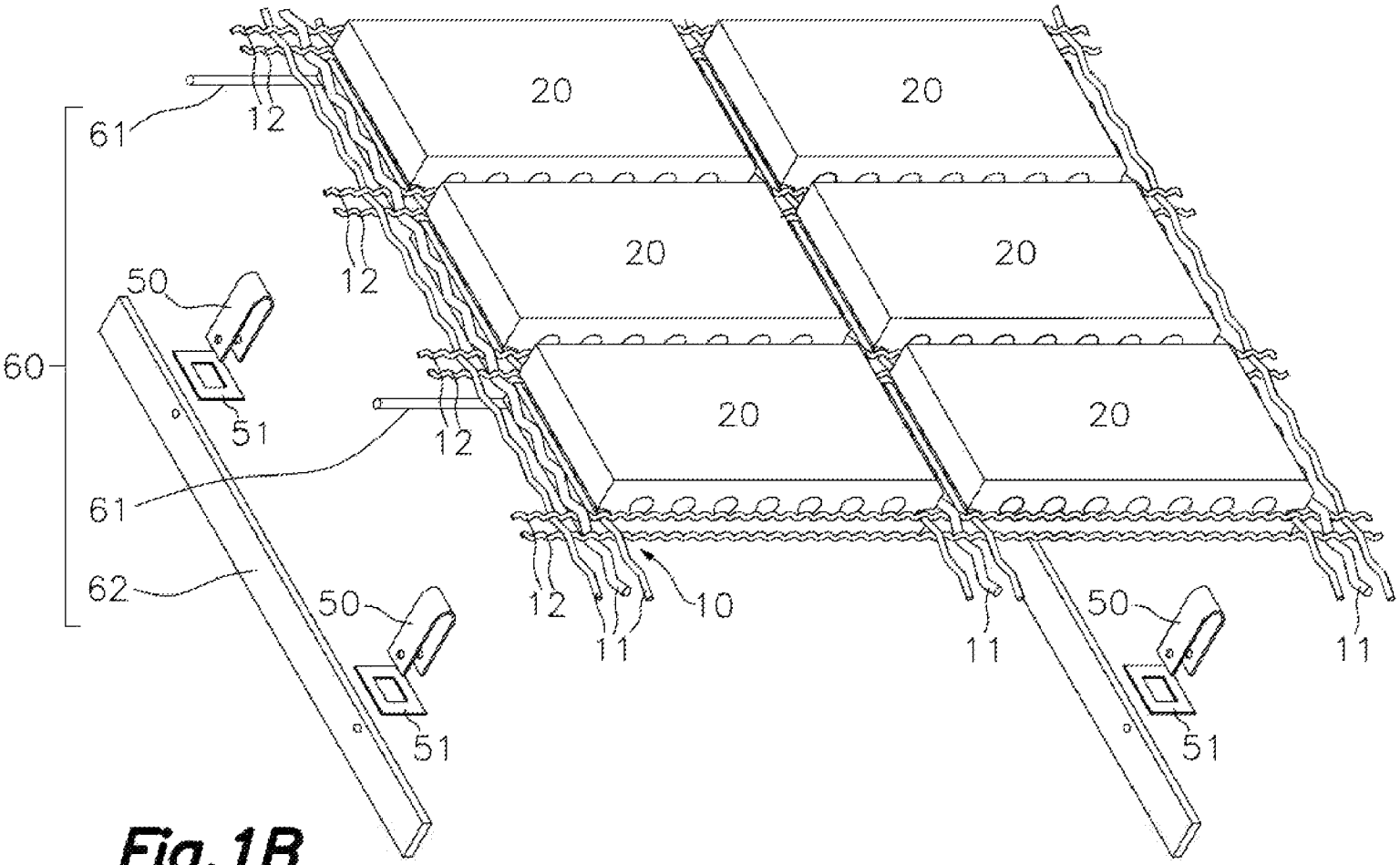
FIG. 1B shows a perspective view such as the one shown in FIG. 1A, but corresponding to another embodiment wherein the first rods are horizontal and are supported at intermediate points to multiple first profiles, generating a horizontal architectural enclosure.

The proposed improved flexible brick sheet is provided with a plurality of bricks 20 joined to each other by a plurality of interwoven flexible rods 10 forming a lattice which retains said bricks 20, as shown in FIGS. 1A and 1B.

The lattice will be supported on a structural element 60 which includes at least a first profile 61 and multiple second profiles 62 perpendicular to the first profile 61.

Figure 3:
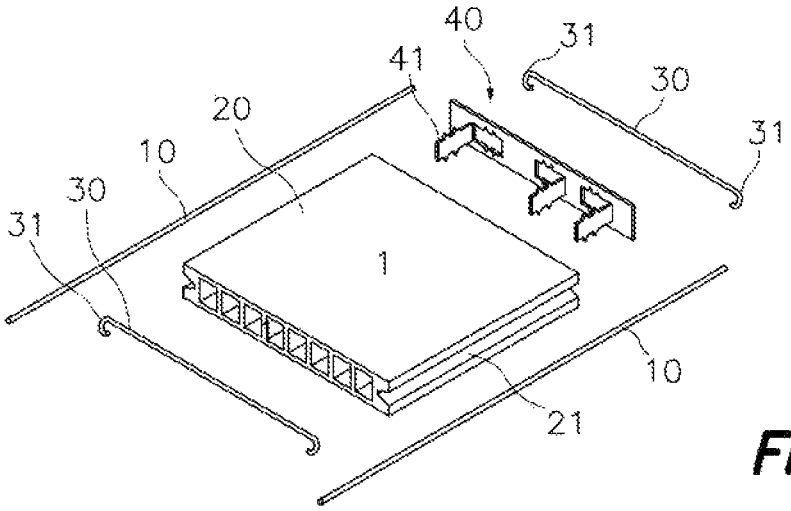
FIG. 3 shows an exploded perspective view of a portion of the proposed flexible sheet that includes a brick provided with two grooves on opposite sides, two rods located on opposite sides of the brick facing said grooves, two retaining devices and a fall-preventing device removed from the brick.
Figure 4:
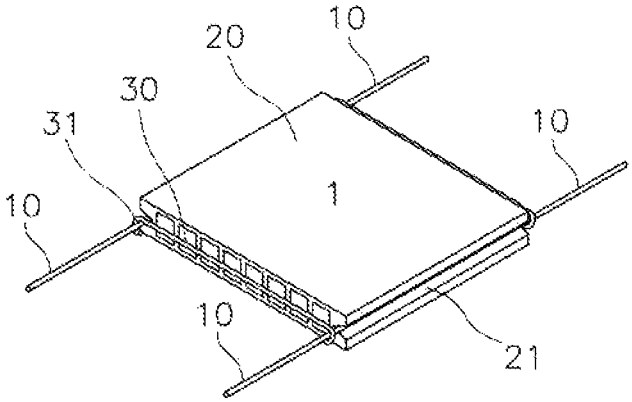
FIG. 4 shows the same embodiment of FIG. 3 but assembled, the two rods being inserted in the two grooves of the brick located on opposite perimetric sides of the brick, the two rods being joined to each other by two retaining devices located on opposite ends of the brick and the fall-preventing device being inserted within the through-holes of the brick.
Figure 5:
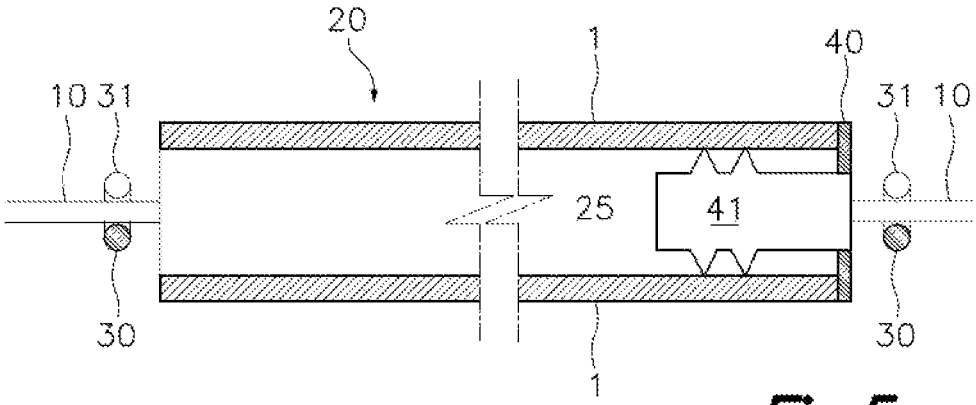
FIG. 5 shows a longitudinal section of a brick joined to the lattice of interwoven rods, said brick including a fall-preventing device inserted in the through-holes of the brick 20.

In FIGS. 3 and 4 a view is shown of a fragment of said flexible sheet, only showing a brick 20 and the surrounding rods 10.

The rods 10 that form the mesh are divided into first rods 11 parallel to each other attached by an end to a first profile 61 included in the structural element 60, and second rods 12 parallel to each other, orthogonal to the first rods 11. Therefore, the first rods 11 are the ones connecting the flexible brick sheet to the structural element 60 by their ends, providing support to the assembly.

It will be understood that the first profile 61 included in the structural element 60 will be connected to a support or to the ground and will be sized to support the loads of the flexible brick sheet.

In an example shown in FIG. 1A, a single first profile 61 will be attached to the building structure, on its façade, allowing for anchoring the flexible brick sheet in a vertical position lining said façade and the first rods 11 remaining vertically arranged with an upper end attached to said first profile 61.

In another example, shown in FIG. 1B, multiple first profiles 61 will be located in a horizontal position in such a way that the flexible brick sheet and the first rods 11 are located in a horizontal position forming a pergola, the first rods 11 remaining supported on the first profiles 61 at intermediate points.

According to another embodiment, not shown, the first rods 11 will form a catenary arch by the effect of gravity. In such a case the two ends of the first rods will be joined to two first profiles 61 located on both ends thereof, forming a pergola in the shape of a catenary.

In any case, each one of several first rods 11 will be opposite to a second profile 62 of the structural element 60 their entire length. In addition to connecting the first rods 11 to the structural element 60 by their end, this makes it possible for said first rod 11 facing a second profile 62 of the structural element 60 to be anchored thereto, also at intermediate positions, by clamps 50.

Figure 2:
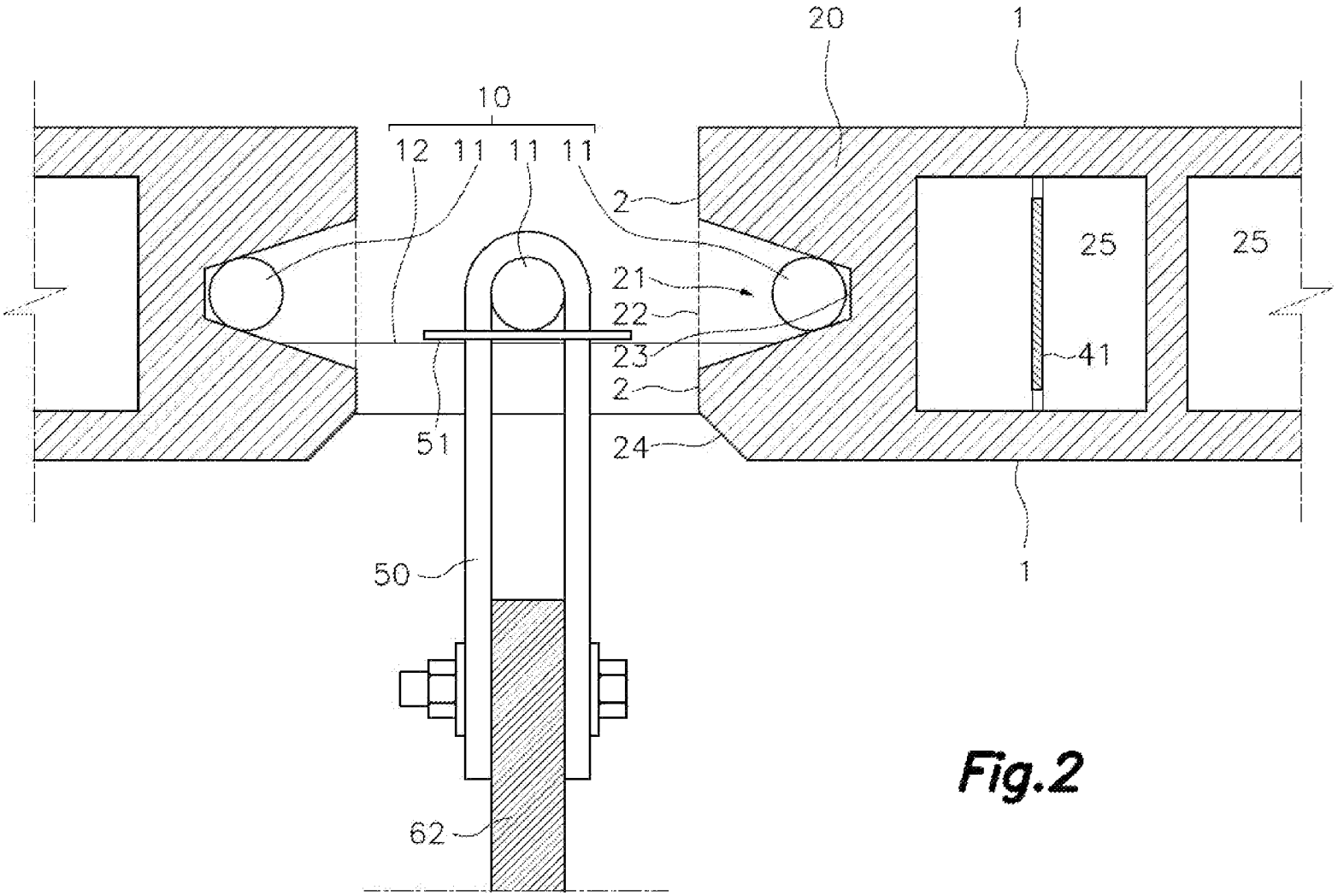
FIG. 2 shows a cross sectional view of two adjacent bricks, in the area of the groove of the brick, a rod being inserted within said groove, and a rod being joined by a clamp to a portion of the structural element facing said rod.

In FIGS. 1 and 2 said clamps 50 are shown, which in this embodiment have a U shape, which are located surrounding a first rod 11 by a closed end, and the second profile 62 of the structural element 60 remaining screwed by another open end of said U-shaped clamp 50.

Said clamp 50 prevents the first rod 11 anchored thereto from being shifted, limiting the possible swaying or vibration that the flexible brick sheet may suffer due to the wind, for example.

Said clamps 50 are placed at regular intervals along the first rod 11, and also provide an additional anchor of the entire flexible brick sheet to the structural element 60 in the event the connection of the ends of the first rods 11 should fail.

A washer 51 can be threaded around the clamp 50, pressing the first rod 11 against the intrados of the arcuate intermediate portion of the clamp 50.

According to the embodiment shown in FIGS. 3 and 4 the brick is a flattened rectangular brick 20 provided with two main sides 1 parallel to each other connected by four perimetric sides 2 of size smaller than the two main sides 1.

The two smaller perimetric sides 2 are connected with each other by through-holes 25 which traverse the whole the brick 20 from side to side.

Each one of the other two perimetric sides 2 is provided with a groove 21 which runs along their larger length. Each groove 21 is provided with an opening 22 which gives access to its interior, defined on the perimetric side 2 on which it sits. The part of the interior of the groove 21 furthest from the opening 22 is the bottom portion 23.

In the present embodiment, the opening 22 has a size larger than the bottom portion 23, so that the width of the groove 21 is decreasing, defining a wedge-shaped cross section.

In the cross section shown in FIG. 2 it is observed how, in the present embodiment, the first rod 11 has a cross section smaller than the opening 22 and larger than the bottom portion 23. This eases the insertion of the first rod 11 within the groove 21, through the opening 22 and its insertion until it remains nested, guaranteeing a firm retention therein, keeping it from being displaced and generating noises once the flexible sheet is installed.

Although in this embodiment the rod 10 inserted in the groove 21 is a first rod 11, it is also contemplated that it may be a second rod 12 which is inserted in the groove 21 of the brick 20.

In order to facilitate the assembly operations of the flexible sheet it is proposed that the ridges of the brick 20 parallel to the grooves 21 be bevelled ridges 24. This allows a brick 20 to be inserted within the lattice of interwoven rods 10 placing said brick 20 on the lattice of rods 10, in the position which said brick 20 will have to occupy, two rods 10 being supported on the two bevelled ridges 24. By applying pressure on the brick 20, the two rods 10 will slide on the bevelled ridges 24, becoming separated and allowing for the insertion of the brick 20.

In order to avoid an accidental removal of the rod 10 from the interior of the groove 21, which could cause the fall of the brick 20 from the flexible sheet, it is proposed to also include retaining devices 30.

In the present embodiment, each retaining device 30 consists of a rod with both its ends bent creating hook configurations 31. Each retaining device 30 is located transversally to the rods 20, each hook configuration surrounding one of said rods 10, in such a way that the retaining device 30 prevents the two rods 10 joined by said retaining device 30 from becoming separated.

In this case, the retaining device 30 is placed adjacent to one of the perimetric sides 2 of the brick 20 which is not provided with grooves 21, with its two ends provided with hook configurations 31 facing the insertion point of the rods 10 in the grooves 21.

The distance that separates the two hook configurations 31 will be smaller than the distance that separates the openings 22 of the two grooves 21 of one same brick 20, but larger than the distance that separates their respective bottom portions 23. Thereby, the retaining device 30 will keep the rods 10 inserted within the two mutually opposing grooves 21 of the same brick 4020 from falling out.

Additionally, it is also proposed to include a fall-preventing device 40 which, upon the accidental breakage of a brick 20, keeps parts thereof from falling off the flexible sheet.

Said fall-preventing device 40 consists of an element provided with shanks 41 conceived to be snuggly inserted inside the through-holes 25 of the brick 20, said fall-preventing device 40 therefore having a comb-like shape.

Optionally, it is proposed that said shanks 41 be harpooned, that is, provided with flexible projecting teeth that contact the inside walls of the through-holes 25 causing their deformation when being inserted therein, thereby achieving better retention.

It will be understood that the different parts constituting the invention described in an embodiment may be freely combined with the parts described in other different embodiments, even if said combination has not been explicitly described, as long as no prejudice exists in the combination.

The invention claimed is:

1. An architectural enclosure composed of a structural element and an improved flexible brick sheet, the structural element comprising at least one first profile and multiple second profiles perpendicular to the first profile and the improved flexible brick sheet comprising:

a plurality of interwoven flexible rods forming a lattice of first rods parallel to each other attached to the at least one first profile and of second rods parallel to each other orthogonal to the first rods, and a plurality of bricks provided with two main opposite sides of larger size, and four perimetric sides, at least two of the bricks are mutually opposing and include grooves as fastening configurations, each groove being accessible through an opening and provided with a bottom portion corresponding to part of the groove furthest away from the opening, the grooves running along the perimetric sides having a larger length, the grooves containing at least parts of some of the rods to retain the bricks in the lattice;

characterized in that some of the first rods are facing the second profiles their entire lengths, and are joined thereto at regular intervals by clamps, the clamps being attached to the second profiles and surrounding portions of the first rod keeping the second rods from sliding along the first rods through the clamp.

2. The architectural enclosure according to claim 1 wherein the opening of each of the grooves is wider than the bottom portion thereof.

3. The architectural enclosure according to claim 2 wherein the bottom portion of each of the grooves and the part of the rod contained therein have complementary shapes and sizes, producing a nested joint of the part of the rod in the bottom portion.

4. The architectural enclosure according to claim 2 wherein each groove has a wedge-shaped section.

5. The architectural enclosure according to claim 2 wherein the bottom of each of the grooves has a width equal to or smaller than the width of the part of the rod contained within the groove ensuring the nesting of the rod at the bottom of the groove or the retention of the rod between opposed groove walls of the groove.

6. The architectural enclosure according to claim 1, wherein at least a ridge of each brick, corresponding to the joint ridge between a main side and a perimetric side containing a groove, is a bevelled ridge.

7. The architectural enclosure according to claim 1, wherein two parallel rods, one located on each side of a brick, have parts inserted in two grooves of the brick located on opposite perimetric sides thereof, and at least one retaining device connects both rods to each other, the retaining device being connected to a portion of each rod adjacent to the part of the rod inserted within the groove.

8. The architectural enclosure according to claim 7 wherein the retaining device is a rigid rod with hook configurations on the rigid rod ends, each hook configuration surrounding one of the rods.

9. The architectural enclosure according to claim 1, wherein the bricks include multiple through-holes going therethrough from one perimetric side to another opposite perimetric side.

10. The architectural enclosure according to claim 9 wherein the improved flexible brick sheet also includes a fall-preventing device at least partially snuggly inserted in at least some of the multiple through-holes.

11. The architectural enclosure according to claim 10 wherein the parts of the fall-preventing device inserted in the through-holes of the brick are harpooned shanks.

12. The architectural enclosure according to claim 1, wherein each clamp consists of a U-shaped piece provided with two mutually opposing straight ends connected through an arcuate intermediate portion, defining a housing traversed by the first rod.

13. The architectural enclosure according to claim 12 wherein a portion of the structural element is located between the mutually opposing straight ends of the clamp, and a screw or rivet goes through both the portion of the structural element and the two mutually opposing straight ends, producing attachment between the clamp and the structural element.

14. The architectural enclosure according to claim 12 wherein a washer is threaded around the clamp, pressing the first rod against an intrados of the arcuate intermediate portion of the clamp.

15. The architectural enclosure according to claim 1, wherein:

the at least one first profile is a single first crowning profile, the first rods are vertical and are joined to the first profile by one of their ends, defining a vertical suspended architectural enclosure; or the at least one first profile is two first end profiles, the first rods forming a catenary arch and the two first profiles being joined by their two ends, defining a catenary architectural enclosure; or the at least one first profile is a plurality of first parallel profiles, the first rods are horizontal and are joined to the first profiles at intermediate points defining a horizontal architectural enclosure.

* * * * *